US005427557A

United States Patent [19]

Lunden, Sr.

[11] Patent Number: 5,427,557

[45] Date of Patent: Jun. 27, 1995

[54] SELF-PROPELLED ICE RESCUE DEVICE AND COMPONENT

[76] Inventor: Kenneth Lunden, Sr., R.D. 1 Box 413, Belvidere, N.J. 07823

[21] Appl. No.: 209,071

[22] Filed: Mar. 7, 1994

[51] Int. Cl.[6] ..... B63C 9/32

[52] U.S. Cl. ..... 441/82; 180/319; 182/12; 441/80

[58] Field of Search ..... 182/12; 180/167, 319, 180/2.1, 169, 19.1, 218; 441/80, 82

[56] References Cited

U.S. PATENT DOCUMENTS

| | | | |
|---|---|---|---|
| 3,026,545 | 3/1962 | Brainard II | 441/80 |
| 3,762,478 | 10/1973 | Cummins | 180/6.7 |
| 4,079,953 | 3/1978 | Howarth, Jr. | 280/12.1 |
| 4,179,764 | 12/1979 | Beller et al. | 440/48 |
| 4,545,315 | 10/1985 | Becherer | 114/61 |
| 4,753,620 | 6/1988 | Arney | 441/83 |
| 4,902,260 | 2/1990 | Im | 446/154 |
| 4,968,046 | 11/1990 | Ceramanics et al. | 280/12.11 |
| 5,203,729 | 4/1993 | Beller et al. | 440/48 |

FOREIGN PATENT DOCUMENTS

| | | | |
|---|---|---|---|
| 0152315 | 11/1981 | German Dem. Rep. | 441/80 |
| 3626322 | 2/1988 | Germany . | |

*Primary Examiner*—Brian L. Johnson
*Assistant Examiner*—Victor E. Johnson
*Attorney, Agent, or Firm*—Kenneth P. Glynn

[57] ABSTRACT

A self-propelled ice rescue device component, as well as the device itself. The component includes (a) a main support frame; (b) a motor attached to the main support frame; (c) a power source connected to the motor for driving the motor; (d) a control mechanism attached to either the power source or the motor or both; (e) a flexible cord member having a first end and a second end, the first end being attached at least to the control mechanism said second end being remotely located from the main support frame so as to be freely useable by an operator; (f) a plurality of rotator members driveably connected to the motor; and, (g) a connector on the main support frame for attaching the self-propelled ice rescue device component to a floatable base platform. The device itself is one which encompasses the aforesaid component with a floatable base platform removably or permanently attached thereto. In one preferred embodiment the floatable base platform is a ladder with floatation devices thereon.

17 Claims, 6 Drawing Sheets

FIG. 5
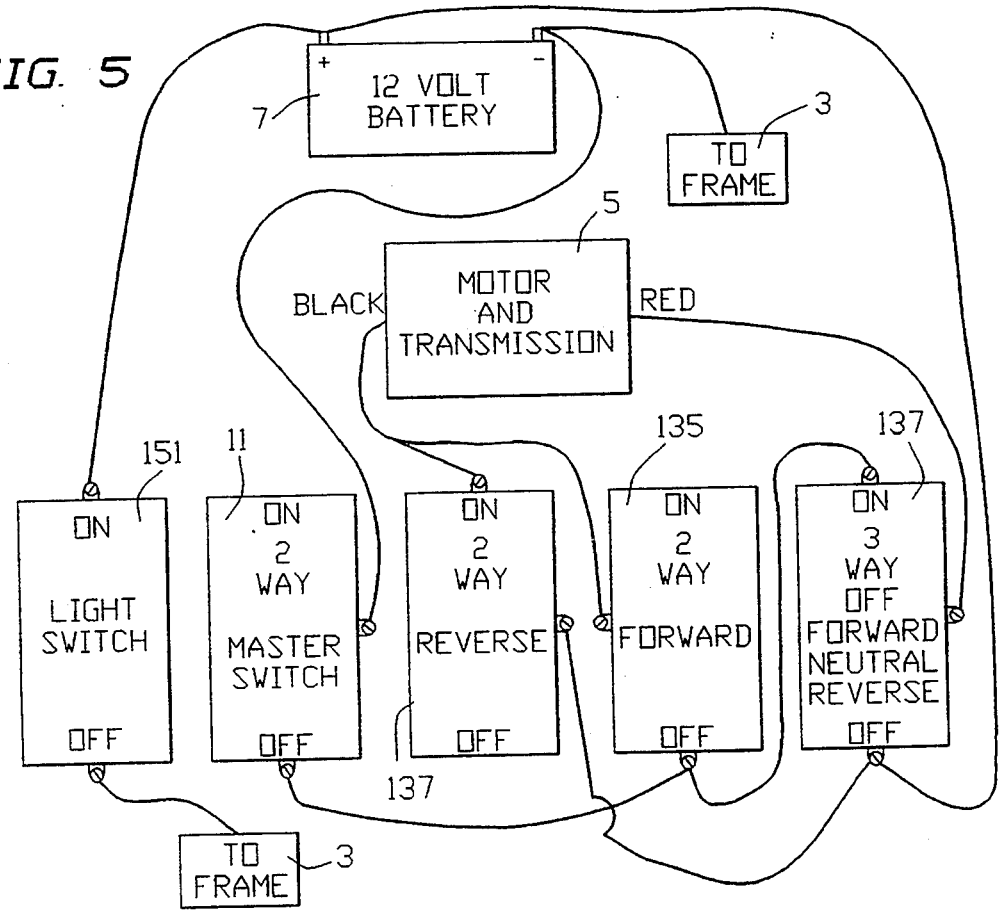
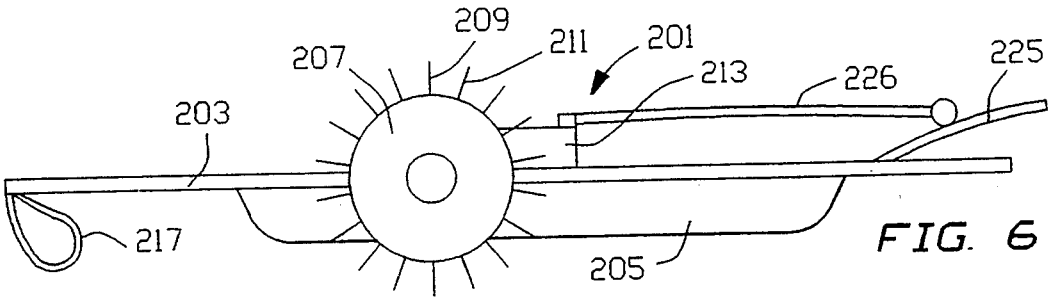
FIG. 6
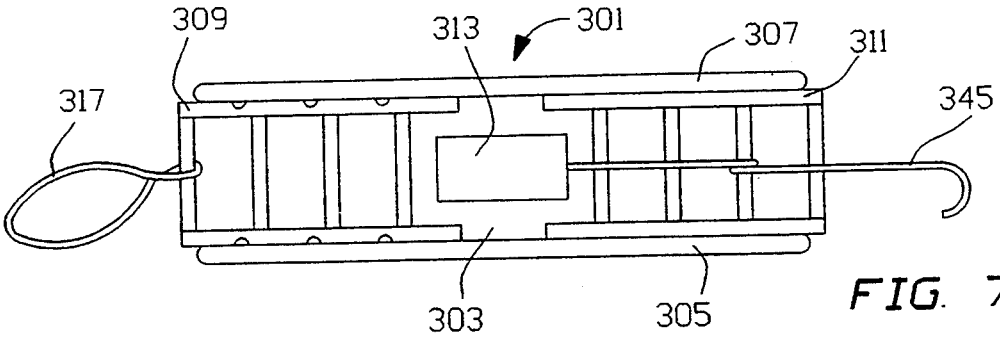
FIG. 7

SELF-PROPELLED ICE RESCUE DEVICE AND COMPONENT

BACKGROUND OF THE INVENTION

1. Field of the Invention

The present invention is directed to a self-propelled ice rescue device. More particularly, the device is one which uses motorized mobilization for movement of a base platform such as a ladder across dangerous ice to a victim while being operated from the shore by as few as one rescuer. More particularly, it is directed to such a device that includes control means which may be remote control or remotely operated control and includes a feed chord for the user so as to control the direction and movement of the device itself to a victim of an ice break.

2. Information Disclosure Statement

The following is representative of the prior art involving ice rescue:

U.S. Pat. No. 4,079,953 issued to William F. Howarth, Jr. on Mar. 21, 1978 describes an elongated, narrow buoyant, ice rescue craft having a flat, planar, hard bottom, upwardly inclined forward and rearward end walls, upstanding side walls and a full length, flat, planar, top deck of hard material is formed of two identical half sections piano hinge pivoted to each other transversely of the center of the top deck and having releasable latches to retain it in extended position or in over folded condition for storage in the trunk of an automobile. A recess is provided in each opposite end of the top deck, each containing a coil of recovery line having an end affixed to the adjacent end wall. Outriggers may also be provided.

U.S. Pat. No. 4,968,046 issued to Michael J. O'Connell et al on Nov. 6, 1990 describes a light weight amphibious water to ice rescue sled. Foam is sandwiched between baffles and two sheets of low friction enameled aluminum. The aluminum is bent to form waterproof seams between the sheets along the top edge and small runners along the bottom sheet. The body of the sled is shoulder width and narrow in depth to permit easy and rapid manual propulsion over ice and in water. All seams are riveted together, a top edge seam is a waterproof standing seam and the others are silicone treated for waterproofing. Side handles are secured to the body for carrying the sled. A hand-held combination ice grab and water paddle is secured to each side rail for propelling the sled. A front grasping rail is secured by protrusions from the front of the sled for the rescue. A harness cord with a snap hook at both ends is secured to the protrusions for harnessing the victim to the sled if necessary. A long tow line is attached to a rear hook.

Notwithstanding the established prior art, there appears to be no reference which teaches or renders obvious the present invention.

SUMMARY OF THE INVENTION

The present invention is a self-propelled ice rescue device component, as well as the device itself. The component includes (a) a main support frame; (b) a motor attached to the main support frame; (c) a power source connected to the motor for driving the motor; (d) a control mechanism attached to either the power source or the motor or both; (e) a flexible cord member having a first end and a second end, the first end being attached at least to the control mechanism said second end being remotely located from the main support frame so as to be freely useable by an operator; (f) a plurality of rotator members driveably connected to the motor; and, (g) a connector on the main support frame for attaching the self-propelled ice rescue device component to a floatable base platform. The device itself is one which encompasses the aforesaid component with a floatable base platform removably or permanently attached thereto. In one preferred embodiment the floatable base platform is a ladder with floatation devices thereon.

BRIEF DESCRIPTION OF THE DRAWINGS

The present invention is more fully understood when the instant specification is taken in conjunction with the drawings which are appended hereto, wherein:

FIG. 5 shows a wiring diagram for d.c. motor of a present invention device using the control means shown in FIG. 4.

FIG. 6 shows a side view of an alternative embodiment of a present invention device utilizing a pontoon as its floatable base platform;

FIG. 7 shows another alternative embodiment present invention device having a telescopic ladder permanently connected to the main frame;

FIG. 11 shows another embodiment of the rotator members having wheels; and

FIG. 12 shows another embodiment of the rotator members having endless track belts.

DETAILED DESCRIPTION OF THE PRESENT INVENTION

The present invention is directed to solving a number of problems and eliminating a number of risks involved in "ice rescue". All too frequently, one or more individuals who have attempted to traverse, play, skate, sail or otherwise use frozen lakes, ponds and rivers suffer the ill fate of falling through the ice and must be rescued quickly or suffer death by drowning and/or freezing. Rescue attempts made by the first person or persons on the scene sometimes fail for lack of experience or equipment and sometimes would be rescuers compound the problem by themselves becoming victims.

Professional rescuers such as rescue squad members and firemen are more successful due to a combination of proper equipment and training. However, in those environments where only one or two professionals arrive at a scene, the rescue efforts are more difficult because it takes considerable strength to pull a person out of ice-locked or ice-encompassed water. Further, even when adequate personnel are available, rescuers typically travel across hazardous ice with ropes, hook poles, ladders or the like, and run the risk of further mishap.

The present invention devices are directed to the elimination of the aforesaid problems and risks by providing for ice rescue capabilities which may be safely and successfully operated by a single individual without the need for that individual to even contact the ice.

Thus, the present invention devices have been developed to traverse ice by distant or remote operation by a user while also providing for a stable and reliable manner of removing a victim from the water and returning that victim to shore.

In one embodiment of the present invention, the invention is a component which is attachable to a standard ladder heretofore used by firemen and rescue squad members so that it may be retrofitted to existing equipment. This embodiment includes a main support frame, a motor, a power source, a control mechanism, a flexible cord such as a rope or a wire and at least two rotator members which are driveably connected to the motor, as well as connecting means for attachment to a floatable base platform. In another embodiment, the aforesaid component includes a floatable base platform which may be permanently or removably attached to the main frame via the connecting means and this platform may be a small flat boat, pontoon, sled, raft, ladder, skids or other platform with inherent or attached floatation means. For example, the platform may be a sealed, hollow metal floatable member, an inflatable raft, a mini "catamaran" or a foldable/unfoldable or telescopically extensive platform or ladder with floatation tanks, barrels or even life jackets attached thereto.

Figure 1:
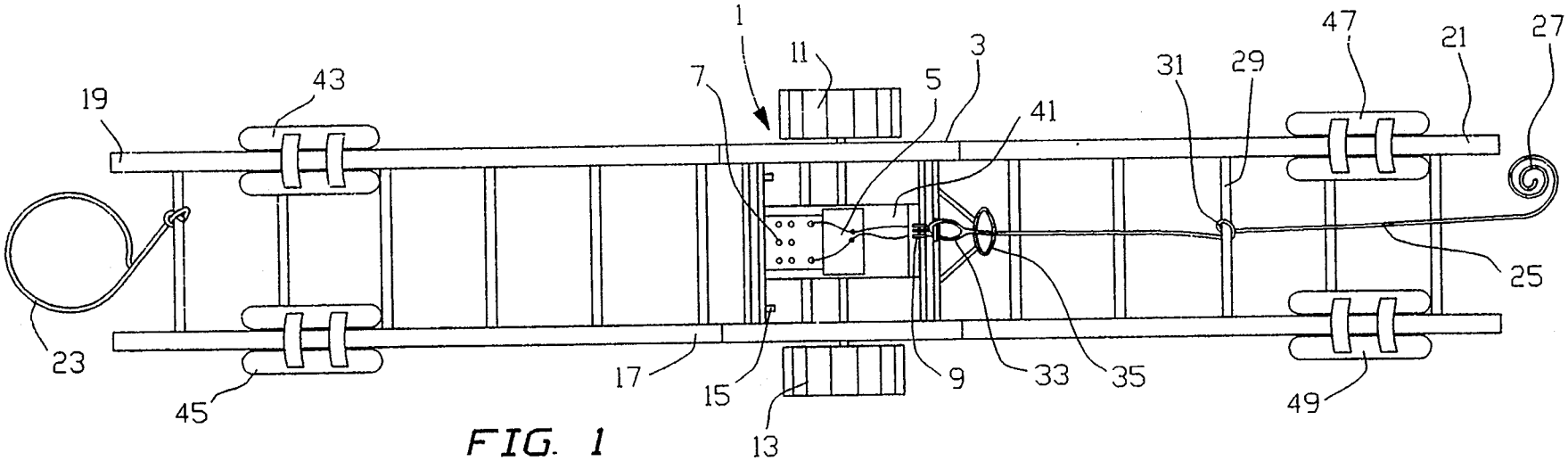
FIG. 1 shows a top view of one embodiment of a present invention self-propelled ice rescue device.

Referring now to FIG. 1, there is shown a present invention self-propelled ice rescue device component 1 which includes a main frame 3 and a motor 5, as well as a battery 7. This is shown in its top view and main support frame 3 also has a control mechanism 9 as well as rotator members which in this embodiment are paddle wheels 11 and 13 connected to motor 5 with a transmission (not shown) connected to the control mechanism. Ladder 17 is attached to main support frame 3 via connecting means 15. Distal end 19 of ladder 17 has a victim loop 23 which is used to allow a victim to grab the free flowing loop or rope rather than rely upon holding a rung of the ladder. In preferred embodiments, victim loop 23 may be used by the victim by slipping the loop over the head and arms and having the loop under the armpits for subsequent passive rescue of the victim. That is, the use of victim loop 23 will enable the rescuer to save the victim even if the victim is unable to hold on any longer or is otherwise incapacitated from injury or temperature. At the proximal end 21 of ladder 17 is a rope 25. This has a user end 27 which may be anchored to a tree, a truck or other stable, reliable anchor on shore and the user will hold rope 25 near user end 27 to move the rope 25 to the left or right so as to control the general direction of movement of the device. Paddle wheels 11 and 13 will move present invention self-propelled ice rescue device 1 in a straight line away from the user unless the user pulls on the rope to the left or right to shift its direction. Additionally, rope 25 has loop 31 passed once around a ladder rung to aid in directional stability but freely moves around rung 29 so as to pull at control mechanism rope portion 33. Rope 25 at control mechanism portion 33 passes through a main support frame guide loop 35 so as to initiate pull and release functions on control mechanism 9. Since control mechanism 9 has a series of operational modes which are more fully described in subsequent figures, pulling and releasing rope 25 enables a rescuer user to shift the motor 5 relative to the paddle wheels 11 and 13 to be in the forward, neutral or reverse operational mode. Wiring 41 connects control mechanism 9 to battery 7 and motor 5 as well as a transmission not shown. Life jackets 43, 45, 47 and 49 are used as flotation devices but the flotation devices could be any of those described above. Additionally, the ladder 17 may be permanently connected to main support frame 3 and therefore constitute a single device, or, in the alternative, the ladder 17 may be removably attached to main support frame 3 and thus, when ladder 17 is removed therefrom, the present invention would constitute an ice rescue device component.

Figure 2:
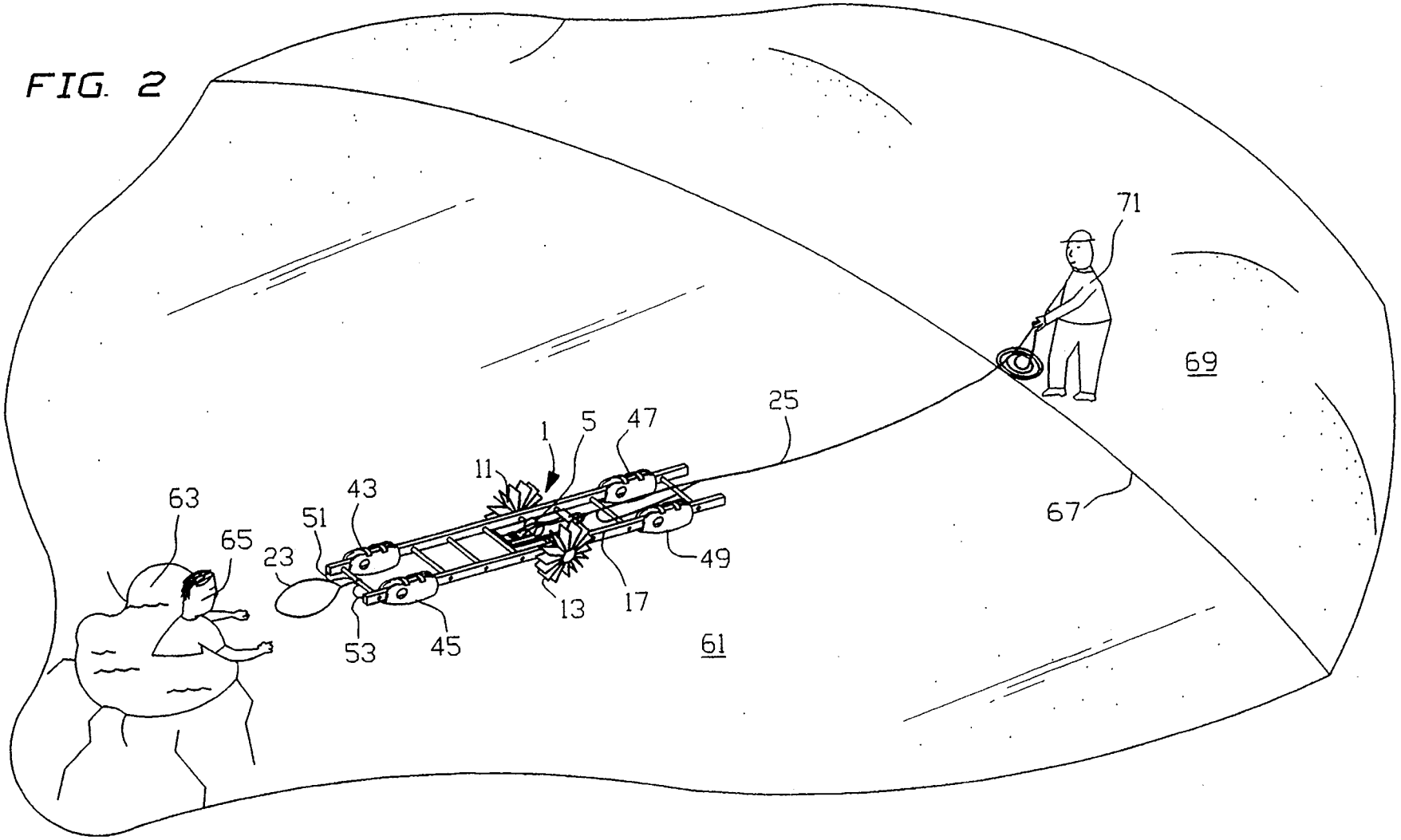
FIG. 2 shows a perspective view of an ice rescue utilizing the present invention device shown in FIG. 1.

Referring now to FIG. 2, there is shown a perspective view of an ice rescue utilizing the present invention device 1 shown in FIG. 1. All of the like parts are like numbered and, because device 1 is not shown in great detail, all parts in this figure are not numbered. As can be seen here, ice 61 on pond 63 has been broken and victim 65 is floating and seeking rescue. Rescuer 71 has extended rope 25 and is guiding device 1 directly toward victim 65. Rescuer 71 will subsequently pull on rope 25 to stop and then to reverse the present invention ice rescue device 1 as victim 65 utilizes loop 23 for attachment thereto. Ladder hook 51 and 53 are shown as add on features to the ladder 17, and these may act as skids or, conversely, as uprights to add alternative means for a victim to hang on to the ice rescue device. Once victim 65 is somehow engaged with device 1, user 71 will reverse the direction of the motor 5 and paddle wheels 11 and 13. Thereby utilizing the friction from the paddle wheels and the power of the motor to extract victim 65 from the pond 63 without user 71 having to exert tremendous energy, without user 71 running the risk of having to traverse ice 61 and without user 71 needing the aid of other rescuers. Thus, victim 65 will be safely towed to shore 67 and to land 69 for subsequent emergency treatment.

The above described present invention device may be used by professional fire fighters and rescue squad members as well as others and may be operated by a single man or woman or even a young child. The component aspect of the invention is readily usable with a roof ladder and standard issue life jackets and thus is retrofittable with conventional water rescue apparatus, fire department apparatus and rescue squad apparatus.

Figure 3:
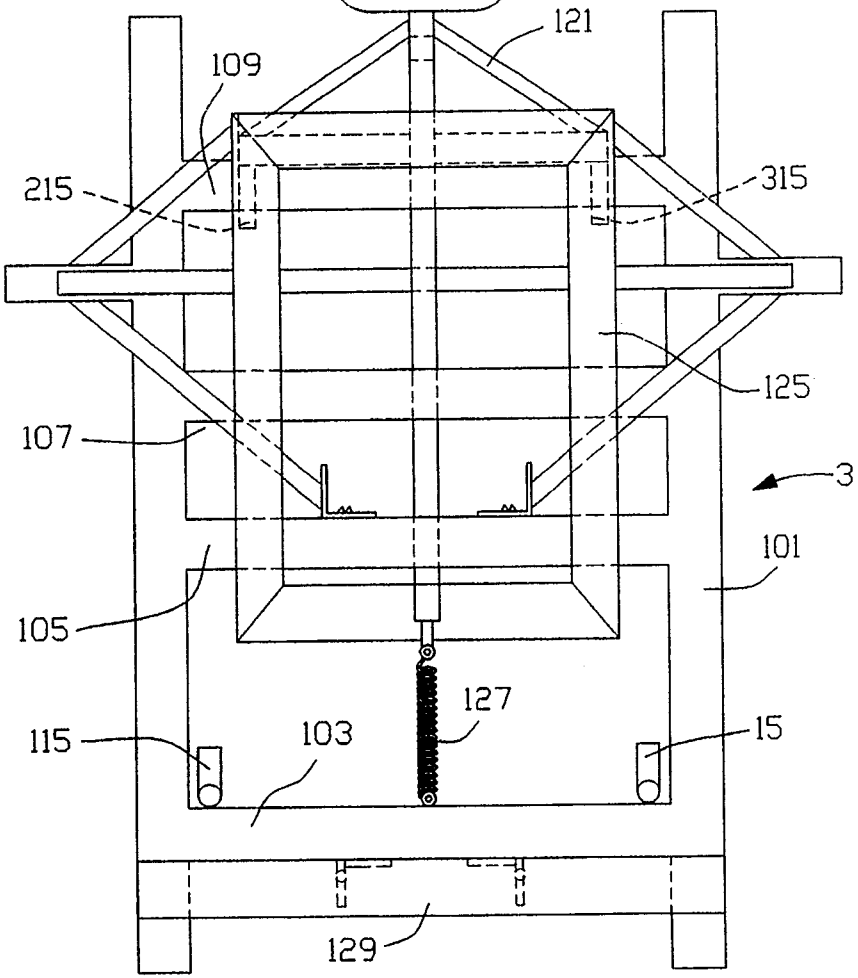
FIG. 3 shows a top view of details of a main support frame which may be used in a present invention self-propelled ice rescue device.

FIG. 3 shows a top view of details of the main support frame 3 which is an embellished version of the main support frame shown in FIGS. 1 and 2. Here, main support frame 3 has an angle iron horizontal base 101 with cross-members 103, 105, 107 and 109 and includes welded hook members which constitutes connecting means 15, 115, 215 and 315. While angle irons are used in one embodiment, here, the main frame could be made of box steel, tubular metal, strip or rod metal or even a sheet of durable metal. Alternatively, structural plastic could be used, such as polystyrene, polyethylene/propylene, fiberglass, etc. These connecting means are used to attach to rungs of ladders. Thus, connecting means 15 and 115 are fixed with respect to angle iron horizontal base 101 and connecting means 215 and 315 are movable relative thereto. A user may pull on handle 35 to move adjustable spring loaded lock device 121 away from connecting means 15 and 115 so as to likewise move connecting means 215 and 315 away from connecting means 15 and 115 so as to widen the distance between these connecting means. This enables main support frame 3 to be rested on top of a ladder and when handle 35 is released connecting means 15 and 115 squeeze together with connecting means 215 and 315 to detachably lock main support frame 3 onto rungs of a ladder. Central support frame 125 is used to house a motor, battery and control mechanism (not shown in this figure). The central support frame may be flat or may include elevated portions to support various components. Spring 127 biases the various connecting means toward one another and plate 129 has been created to support the control mechanism discussed further with respect to FIG. 4 below.

Figure 4:
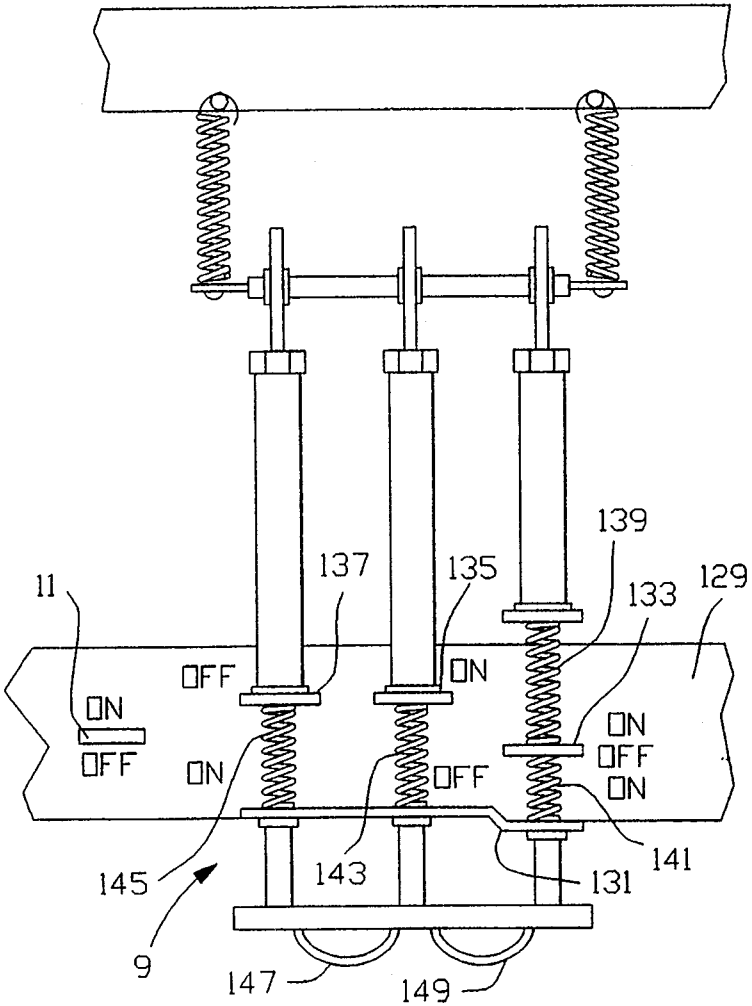
FIG. 4 shows a top view of a control mechanism which may be used as the control means in one embodiment of the present invention.

Referring now to FIG. 4, a top view of the control mechanism 9 is shown in more detail. This includes a main on and off switch 11 and a 3-way switch mounted on plate 129 and upright plate 131. The control mechanism 9 also includes three switches 133, 135 and 137 for three separate operating modes, namely, neutral, forward and reverse. Switch 133 is a three-way switch and switches 135 and 137 are two-way switches in this embodiment. Springs 139 and 141 maintain neutral switch 133 in its off position and spring 143 maintains switch 135 in its on position while spring 145 maintains switch 137 in its off position as shown. The wiring from the switches to the motor and transmission are shown in FIG. 5. By pulling on a rope looped to U-bolts 147 and 149, a user may maintain the control mechanism 9 so as to have the motor and transmission in any of the three operational modes that the user may desire. Other arrangement for switching may now be apparent to the artisan.

FIG. 5 shows one type of wiring diagram which may be used in conjunction with control mechanism 9 shown in FIG. 4. In addition to the switches 11, 133, 135 and 137 shown in both this Figure and FIG. 4, there is an optional spotlight switch 151 to an optional spotlight (not shown). The battery 7 and motor and motor 5 may be as shown in previous figures.

FIG. 6 shows a side view of an alternative embodiment present invention device 201 which includes a flat extended platform section 203, a pontoon 305, a wheel 207 with paddles such as paddles 209 and 211 and an internal combustion engine, transmission and control mechanism shown generally as component 213, user rope 225 and victim loop 217. Rope 225 is tied to platform section 203 and is connected by a loop to stretch cord 226 which is itself directly connected to component 213 for control thereof. Pontoon 205 may be one of two symmetrical pontoons or may be a single unit. It may be either metal or plastic or inflatable material, although metal or plastic would be more durable.

FIG. 7 shows a present invention ice rescue device 301 with a horizontal base platform 303 having extended sidewalls 305 and 307. Telescopically mounted within sidewalls 305 and 307 are extensible ladder sections 309 and 311. Component 313 generically represents the power source, control mechanism and motor and the flotation means would be located on the underside of horizontal base platform 303. Victim loop 317 is located at one end and user rope 225 is located at the other end.

The devices shown in all of the figures are generally operated in accordance with the description above with respect to operation of the device shown in FIGS. 1 and 2. The user rope shown in the various figures has been described as useful for both directional control and anchoring of the device, as will as for operation of the control mechanism. Without changing FIGS. 1, 6 and 7, the control mechanism could be operable by a radio remote control device.

The rotor members may, as mentioned, be rubber tires 111 and 112 as shown in FIG. 11, paddle wheels 11 and 13 as shown in FIG. 1, endless track belts may include 121 and 122 as shown in FIG. 12 or other similar drive means. The rubber tires are particularly useful for warm weather training and may be changed over to paddle wheels, as desired.

Figure 8:
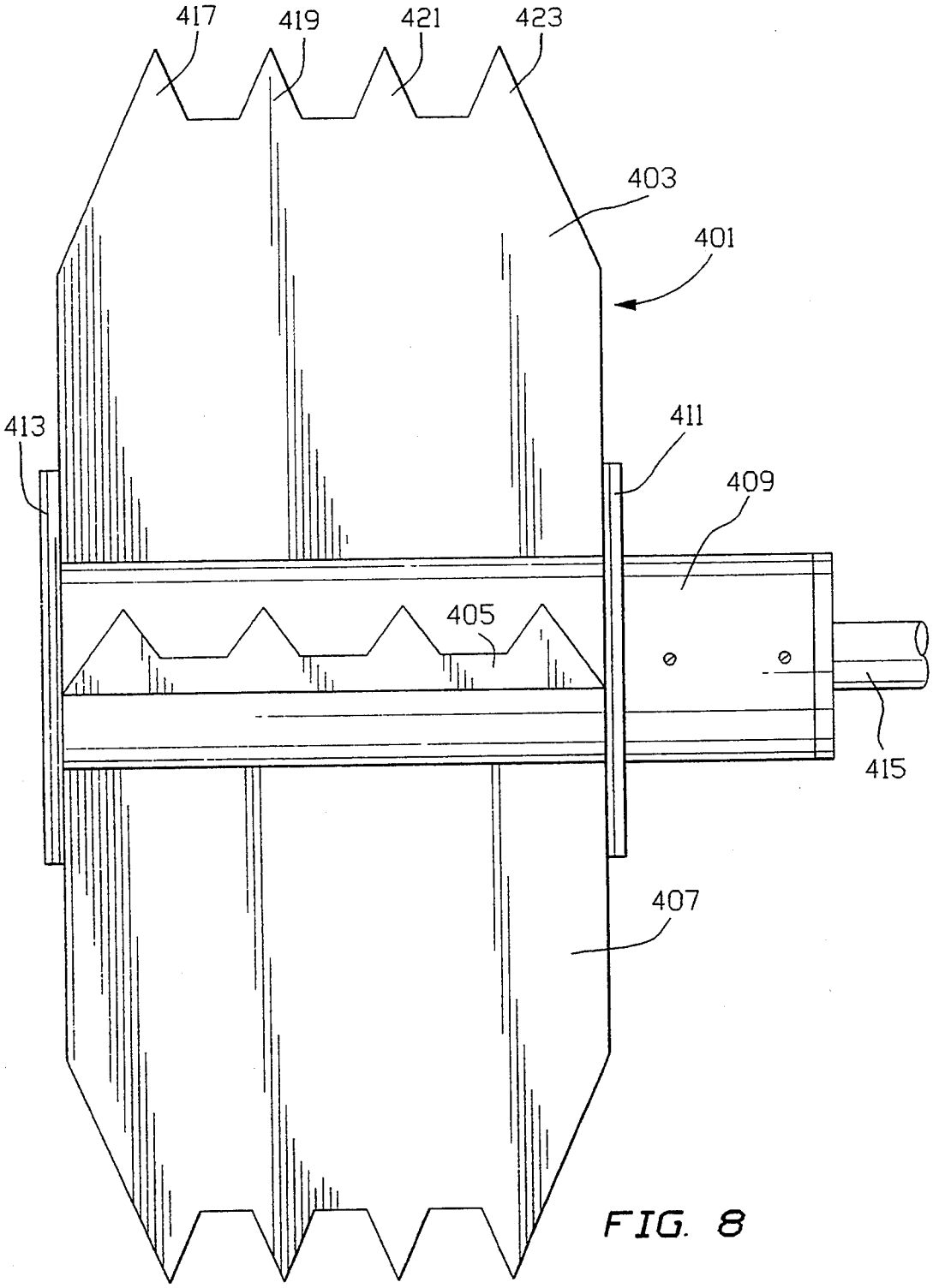
FIG. 8 shows a front view and FIG. 9 shows a cut side view of a preferred embodiment paddle wheel for the present invention device.
Figure 9:
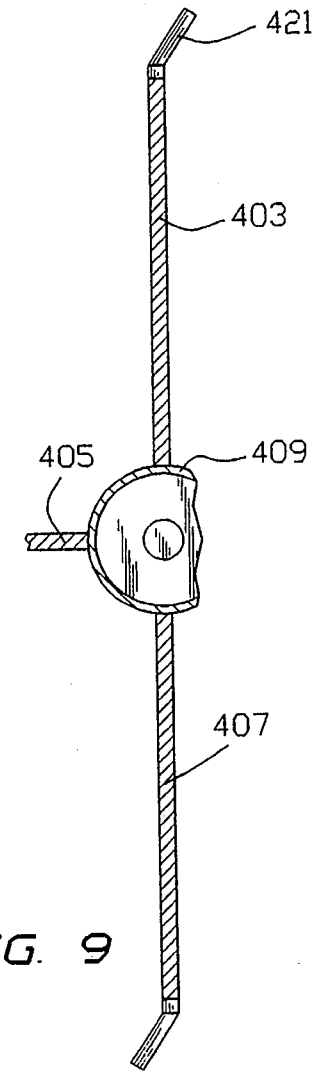

FIG. 8 shows a partial front view and FIG. 9 shows a partial cut side view of a rotator member 401 used in the present invention device. Rotator member 401 includes blades 403, 405 and 407 which are welded onto rotator base 409. A fourth blade (not shown) would be located on the opposite side of blade 405. These blades are welded to rotator base 409 and have side hubs 411 and 413. Rotator base 409 is fixedly mounted on axle 415 which would be connected to a drive motor (not shown). This particular arrangement has each blade adapted for water, ice, and land mobility. Referring specifically to blade 403, tips 417, 419, 421 and 423 have been adapted to dig into ice by being angled as shown in cut side view of FIG. 9. While this rotator member 401 has four blades, a preferred paddle wheel may have eight to twelve blades or any number desired.

Figure 10:
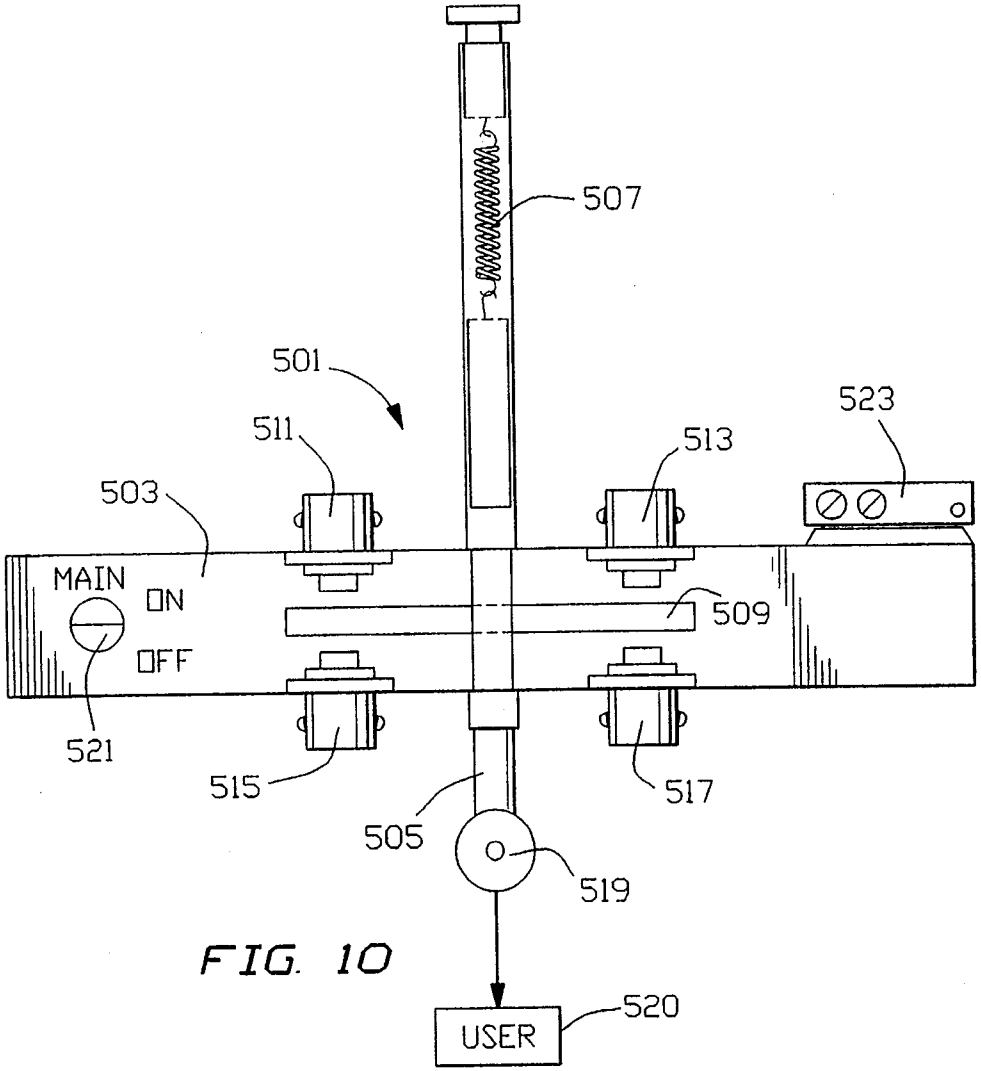
FIG. 10 shows an alternate embodiment control means.

FIG. 10 shows a top view of an alternate control mechanism 501. Control mechanism 501 has a frame 503, a pull rod 505 which is maintained in a first position by spring 507 and has three positions, namely said first position as well as a second position and a third position. In its first position, crossbar 509 depresses switches 511 and 513 so as to maintain a drive system in a forward mode. In its second position, pull rod 505 and crossbar 509 have no contacts with any switches, and thus maintain a neutral mode. When pull rod 505 is in its third position, crossbar 509 depresses switches 515 and 517 to complete contact for a reverse mode. Pull rod 505 includes a connector 519 which would be adapted to a cord and operated by a user 520 in a fashion similar to the control mechanism described with respect to FIGS. 1, 2 and 4 or as described with respect to the control mechanism of FIG. 6. There is a main on/off switch 521 which independently neutralizes the device and there is an optional radio 523 to enable a user to speak to a victim therethrough via a wireless radio transmission.

Obviously, numerous modifications and variations of the present invention are possible in light of the above teachings. It is therefore understood that within the scope of the appended claims, the invention may be practiced otherwise than as specifically described herein.

What is claimed is:

1. A self-propelled ice rescue device, which comprises:

a. a main support frame;

b. a motor mounted onto said main support frame, said motor being supported by said main support frame;

c. power means for supplying power to said motor, said power means being connected to said motor;

d. a control mechanism for controlling the rotation of said motor, said control mechanism being operatively attached to said power means and said motor;

e. a flexible cord for operating said control mechanism, said flexible cord having a first end and a second end, said first end being attached to said control mechanism, said second end being remotely located from said main support frame;

f. a plurality of rotator members, said plurality of rotator members being driveably connected to said motor;

g. a ladder having floatation means mounted thereon; and, h. connecting means on said main support frame for attaching said main support frame to said ladder.

2. The device of claim 1, wherein said ladder has at least one floatation device attached thereto.

3. The device of claim 1, wherein said ladder has a victim loop connected to one end thereof.

4. The device of claim 1, wherein said motor may drive said rotator member in at least three turning modes, said modes being forward, neutral and reverse.

5. The device of claim 1, wherein said plurality of rotator member are paddle wheels.

6. The device of claim 1, wherein said plurality of rotator members are rubber tire.

7. The device of claim 1 wherein said plurality of rotator members include endless track belts.

8. The device of claim 1, wherein said motor is a direct current motor and said power means is at least one storage battery.

9. The device of claim 1 wherein said main support frame is removably attached to said ladder.

10. A self-propelled ice rescue device, which comprises:

a. a main support frame;

b. a motor mounted onto said main support frame, said motor being supported by said main support frame;

c. power means for supplying power to said motor, said power means being connected to said motor;

d. a control mechanism for controlling the rotation of said motor, said control mechanism being operatively attached to said power means and said motor;

e. a flexible cord for operating said control mechanism, said flexible cord having a first end and a second end, said first end being attached to said control mechanism, said second end being remotely located from said main support frame;

f. a plurality of rotator members, said plurality of rotator members being driveably connected to said motor;

g. a ladder having floatation means mounted thereon; and, h. connecting means on said main support frame for permanently attaching said main support frame to said ladder.

11. The device of claim 10, wherein said ladder has at least one floatation device attached thereto.

12. The device of claim 10, wherein said ladder has a victim loop connected to one end thereof.

13. The device of claim 10, wherein said motor may drive said rotator member in at least three turning modes, said modes being forward, neutral and reverse.

14. The device of claim 10, wherein said plurality of rotator members are paddle wheels.

15. The device of claim 10, wherein said plurality of rotator members are rubber tires.

16. The device of claim 10, wherein said plurality of rotator members include endless track belts.

17. The device of claim 10, wherein said motor is a direct current motor and said power means is at least one storage battery.

* * * * *